US006360071B1

(12) United States Patent
Tomizawa

(10) Patent No.: US 6,360,071 B1
(45) Date of Patent: Mar. 19, 2002

(54) IMAGE FORMING APPARATUS WITH CONTROL OF GRINDING OF INTERMEDIATE TRANSFER MEMBER

(75) Inventor: Takeshi Tomizawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,873

(22) Filed: Mar. 29, 2000

(30) Foreign Application Priority Data

Mar. 31, 1999 (JP) ..... 11-091732
Mar. 23, 2000 (JP) ..... 2000-082933

(51) Int. Cl.[7] ..... G03G 15/01
(52) U.S. Cl. ..... 399/302; 399/308
(58) Field of Search ..... 399/302, 107, 399/297, 299, 306, 308, 309, 313; 118/DIG. 1

(56) References Cited

U.S. PATENT DOCUMENTS 5,499,086 A * 3/1996 Matsuno et al. ..... 399/313
5,784,675 A * 7/1998 Inoue et al. ..... 399/297
6,072,976 A * 6/2000 Kuriyama et al. ..... 399/302
6,173,139 B1 * 1/2001 Takahata et al. ..... 399/107

FOREIGN PATENT DOCUMENTS

JP 9-114269 * 5/1997
JP 2000-19853 * 1/2000

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image forming apparatus including an image bearing member for bearing an image; an intermediate transfer member for receiving electrostatic image transfer from the image bearing member and adapted to electrostatically transfer the image to a recording material; and an abrasive member for grinding an image-receiving area of the intermediate transfer member.

42 Claims, 7 Drawing Sheets

IMAGE FORMING APPARATUS WITH CONTROL OF GRINDING OF INTERMEDIATE TRANSFER MEMBER

BACKGROUND OF THE INVENTION

1. Field of the Invention

The present invention relates to an image forming apparatus such as a copying apparatus, a printer or a facsimile apparatus, and more particularly to an image forming apparatus adapted for transferring an image on an image bearing member onto an intermediate transfer member and then transferring the image on the intermediate transfer member onto a recording material.

2. Related Background Art

FIG. 7 shows, in a lateral views, an image forming apparatus for sequentially superposing toner images of plural colors on a same recording material.

In the main body of the image forming apparatus, there is provided an endless intermediate transfer belt 81 running in a direction indicated by the arrow X. Such intermediate transfer belt is formed with a film of dielectric resin such as polycarbonate, polyethylene terephthalate or polyvinylidene fluoride. A recording material 6 such as paper taken out from a feed cassette 60 is supplied, through registration rollers 13 and a conveyor belt 8, to a secondary transfer position of the intermediate transfer belt 81.

Above the intermediate transfer belt 81, there are provided four image forming units Pa, Pb, Pc and Pd in tandem. These image forming units Pa, Pb, Pc, Pd have substantially same structures are different in forming magenta, cyan, yellow and black toner images respectively.

The structure of the image forming unit will be explained in the following, taking the unit Pa as an example. The image forming unit Pa is provided with a rotatably supported drum-shaped electrophotographic photosensitive member (photosensitive drum) 1*a*, around which provided are process devices such as a primary charger 2*a*, a developing device 3*a*, a cleaner 5*a* etc. Since these units are similar in structure, the photosensitive drums alone are numbered as 1*b*, 1*c*, 1*d* in other units Pb, Pc, Pd. The developing devices of the image forming units Pa, Pb, Pc and Pd respectively contain magenta toner, cyan toner, yellow toner and black toner.

The photosensitive drum 1*a* is irradiated with a laser beam bearing an image signal of the magenta component of the original for example through a polygon mirror (not shown), whereby an electrostatic latent image is formed on the photosensitive drum 1*a*. The latent image is developed with magenta toner supplied from the developing device 3*a* to obtain a visible magenta toner image. When the toner image is brought, by the rotation of the photosensitive drum l*a*, to a primary transfer position where the photosensitive drum 1*a* is in contact with the intermediate transfer belt 81, the magenta toner image on the photosensitive drum 1*a* is transferred onto the intermediate transfer belt 81 by a primary transfer bias applied to a transfer charging member 4*a* (primary transfer).

By the time a portion of the intermediate transfer belt 81 bearing the magenta toner image moves to the image forming unit Pb, a cyan toner image is formed on the photosensitive drum 1*b* in the image forming unit Pb in the same manner as explained in the foregoing and such cyan toner image is transferred onto the magenta toner image borne on the intermediate transfer belt 81.

As the intermediate transfer belt 81 moves further, a yellow toner image and a black toner image are similarly transferred in the respective primary transfer portions of the image forming units Pc, Pd onto the aforementioned magenta and cyan toner images. By this time, the recording material 6 supplied from the feed cassette 60 reaches a secondary transfer position through the registration rollers 13, and the four-color toner images on the intermediate transfer belt 81 are collectively transferred onto the recording material 6 by a secondary transfer bias applied to a secondary transfer member 40 (secondary transfer).

After the secondary transfer process, the intermediate transfer belt 81 is subjected to the surface charge elimination by a residual charge eliminator 12, and the secondary untransferred toner remaining on the surface is removed by a cleaning member 16.

The recording material 6 bearing the transferred four-color toner images is separated by a separating portion 10 from the intermediate transfer belt 81 and is conveyed by a conveying belt 8 to a fixing device 11, in which a pair of rollers apply heat and pressure to the recording material 6, thereby fixing the toner images. The fixing device 11 is provided a mechanism for coating releasing oil (such as silicone oil) on one of the fixing rollers in order to improve the releasing property between the recording material and the roller, so that such oil is deposited onto the recording material.

In case of one-side image formation, the recording material 6 bearing the fixed toner image is discharged onto a sheet discharge tray of the apparatus after emerging from the fixing device 11, but, in case of two-side image formation the recording material 6 is contained in a cassette 62 for two-side recording after passing through a surface reversing path 61 provided at the exit of the fixing device 11 and is then fed to the secondary transfer position thereafter for image formation by secondarily transferring the toner image on the other surface (back surface) of the recording material.

The photosensitive drum 1*a* after the primary transfer is subjected to the removal of the toner remaining on the surface thereof after the transfer by a cleaner 51, and is thus rendered capable of the next image formation. The intermediate transfer belt 81 after the secondary transfer is subjected to the removal of surface charge and of the toner deposited on the surface charge and of the toner deposited on the surface by a residual charge eliminating charger 12 disposed downstream of the secondary transfer position and a belt cleaner 16 disposed downstream of the residual charge eliminating charger 12.

In the above-described image forming apparatus, when a high voltage is repeatedly applied to the intermediate transfer belt in the respective primary and secondary transfer portions, the surface resistivity of the intermediate transfer belt may gradually decrease to eventually result in an image defect. This phenomenon is presumably attributable to a fact that discharge phenomena appear not negligibly by an electric field formed between the transfer rollers 4*a*, 4*b*, 4*c*, 4*d* and the photosensitive drums 1*a*–1*d* across the intermediate transfer belt (discharge being presumably generated in gap portions formed at the upstream and downstream sides of an area where the photosensitive drum is in contact with the intermediate transfer belt in each primary transfer portion), thereby deteriorating the surface layer (at the image bearing side) of the intermediate transfer belt or causing deposition of the discharge products onto the surface of the intermediate discharge belt. Such discharge phenomena are presumed to similarly occur also in the secondary transfer portions In fact, in a durability test by current supply to the primary and secondary transfer chargers in the above-described image forming apparatus, the surface resistivity of the intermediate transfer belt was lowered from an initial value of about $10^{13}$ Ω/□ to about $10^{9}$ Ω/□ with the progress of the durability test (measured under normal temperature and normal humidity conditions, with a voltage of 1 kV applied by an electrode according to JIS-K6911). With such loss of the surface resistivity, the volume resistivity was also lowered from about $10^{12}$ Ωcm to about $10^{10}$ Ωcm (measured under normal temperature and normal humidity conditions, with a voltage of 10 V applied by an electrode according to JIS-K6911). Furthermore, this phenomenon does not necessarily occur uniformly in the longitudinal direction (direction perpendicular to the rotating direction) of the intermediate transfer belt.

Such loss in the surface resistivity of the intermediate transfer belt may result in an image defect such as local blank area in the toner image transferred in each primary transfer portion from the photosensitive drum to the intermediate transfer belt, or a counter transfer of the toner, already transferred to the intermediate transfer belt, again to the photosensitive drum. Also in the secondary transfer portion, there may result an image defect such as a local blank area in the toner image transferred from the intermediate transfer belt to the recording material.

Also with the loss in the surface resistivity of the intermediate transfer belt in the prolonged use, the intermediate transfer belt becomes incapable of satisfactorily bearing the toner image electrostatically, leading to an image distortion called "smeared image".

Also in case of two-side image formation on the front and back surfaces of the recording material 6, there may be encountered the following drawbacks.

In the image fixation in the image formation on the front surface of the recording material 6, the releasing oil that has not penetrated in the recording material may remain on the surface thereof. If the image formation is executed on the back surface of the recording material in such state, the front surface of the recording material comes into contact with the surface of the conveying belt 8 so that, by the contact of the conveying belt 8 with the intermediate transfer belt 81 on the secondary transfer, the releasing oil is eventually transferred onto the surface of the intermediate transfer belt 81.

The releasing oil transferred onto the intermediate transfer belt 81 may be transferred onto the photosensitive drum 1 (1*a*–1*d*), by contact of the intermediate transfer belt 81 therewith in an area where the recording material 6 is absent in the course of image formation or in other operation, thereby resulting in a defective image caused by defective charging of the photosensitive drum, defective cleaning or defective development.

For example, if the image formation is executed on a small-sized sheet after two-side image formation on a large-sized sheet, the intermediate transfer belt bearing the releasing oil comes close to or contacts the photosensitive drum at the portion of the intermediate transfer belt out of contact with the recording material, whereby the releasing oil is transferred onto the photosensitive drum. In such situation, a next image formation on a large-sized sheet may show deterioration of the quality of the toner image formed on the photosensitive drum bearing thus transferred releasing oil.

SUMMARY OF THE INVENTION

An object of the present invention is to provide an image forming apparatus capable of preventing image defect caused by transfer of the oil, deposited on the intermediate transfer member, to the image bearing member.

Other objects of the present invention, and the features thereof, will become fully apparent from the following detailed description.

DESCRIPTION OF THE PREFERRED EMBODIMENTS

The present invention will be clarified in detail by embodiments thereof, with reference to the attached drawings.

[Embodiment 1]

Figure 1:
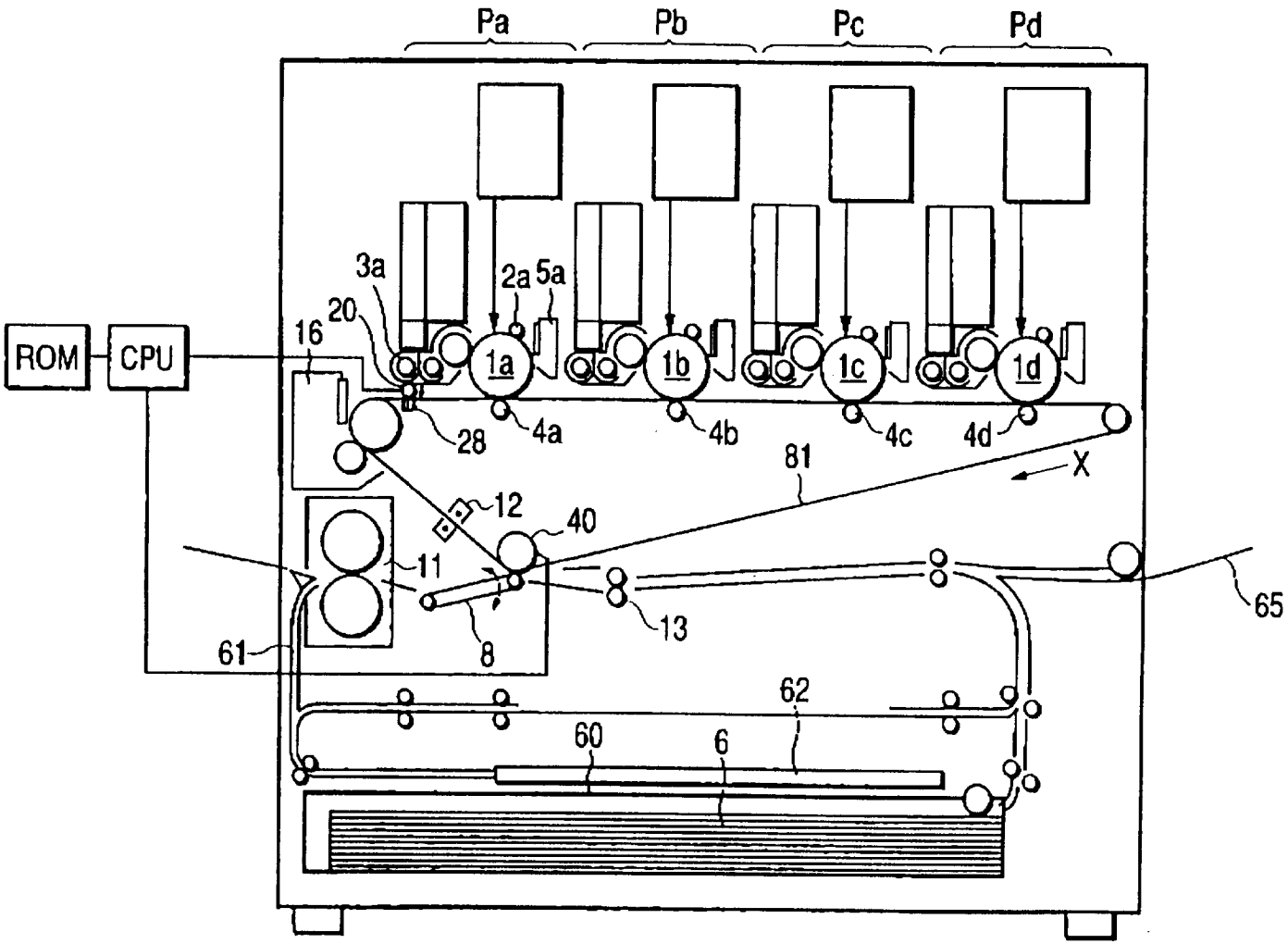
FIG. 1 is a schematic view showing the configuration of an embodiment of the image forming apparatus of the present invention.

FIG. 1 is a schematic view showing the configuration of an embodiment of the image forming apparatus of the present invention.

Figure 7:
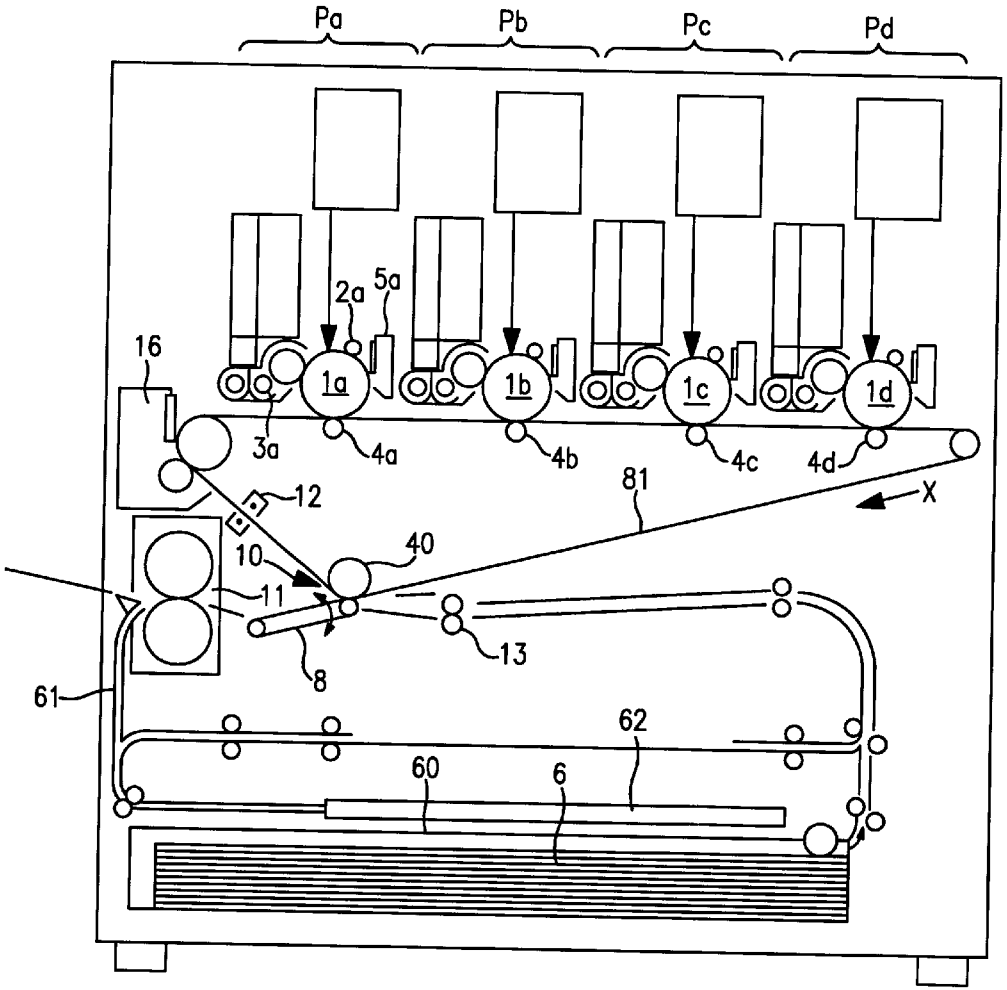
FIG. 7 PRIOR ART
FIG. 7 is a schematic view of a conventional image forming apparatus.

In the image forming apparatus of the present invention, abrasive means (abrasive roller) 20 for an intermediate transfer belt 81 as the intermediate transfer member is provided at a downstream position of the secondary transfer position thereof for the transfer of the toner image onto the recording material, so as to be contactable with and separable from the intermediate transfer belt 81. In the contact position of the abrasive roller 20 and the intermediate transfer belt 81, the moving direction of the abrasive roller 20 is opposite to the moving direction of the intermediate transfer belt 81. In the image forming apparatus of the present invention, other parts are similar to those in the conventional image forming apparatus shown in FIG. 7. Therefore those parts will be represented by numbers same as those in FIG. 7 and will not be explained further.

In the following there will be outlined the image forming process. The toner images of respective colors (yellow, magenta, cyan and black) formed on the photosensitive drums 1*a*–1*d* are electrostatically transferred in succession by contact transfer members (transfer rollers) 4*a*–4*d* and in superposition onto the intermediate transfer belt 81. Subsequently, the toner images of four colors (full-color toner image) are collectively transferred in electrostatic manner from the intermediate transfer belt 81, in the secondary transfer position, by a secondary transfer member (transfer roller) 40 onto the recording material 6 such as paper conveyed to the secondary transfer position at a predetermined timing. In addition to such full-color image forming mode, the apparatus can be selectively switched for example to a monochromatic image forming mode (black-and-white mode) for forming the black toner image only.

In the present embodiment, in order to prevent the defective image resulting from the loss in the surface resistivity of the image bearing surface of the intermediate transfer belt 81 with the lapse of time, a grinding operation is executed on the entire periphery of the intermediate transfer belt 81 by the abrasive roller at a predetermined timing (for example for every 100 recording materials of the image formation operation). Such operation allows to eliminate the aforementioned discharge products deposited on the surface of the intermediate transfer belt 81, thereby preventing the loss in the surface resistivity of the intermediate transfer belt 81. The surface resistivity of the intermediate transfer belt 81 is preferably within a range of $10^{11}$ to $10^{15}$ Ω/□, and, for completely preventing the aforementioned "smeared image", more preferably $10^{12}$ to $10^{14}$ Ω/□.

The surface resistivity was measured under a condition of normal temperature and normal humidity with an applied voltage of 1 kV utilizing an electrode according to the JIS-K6911.

In order to judge the timing of the grinding operation using the abrasive roller, the present embodiment has a detection mode for detecting the durable status of the intermediate transfer belt 81, in addition to the image forming mode for image formation on the recording material.

More specifically, the durable stats of the intermediate transfer belt 81 is judged by applying a predetermined voltage to the secondary transfer roller 40 in the absence of the recording material in the secondary transfer position, and detecting the electric current flowing in the secondary transfer roller 40. In this state the recording material conveying belt 8 serving as the counter electrode is in contact with the intermediate transfer belt 81 and is electrically grounded.

Control means constituted by a CPU discriminates whether the detected current is larger than a value stored in advance in memory means constituted by a ROM, and, if larger, sends a control signal for executing a grinding operation on the intermediate transfer belt 81 by the abrasive roller.

Thus, in the present embodiment, the intermediate transfer belt 81 is subjected to the grinding operation at an appropriate timing, thereby being prevented from unnecessary reduction of the service life of the intermediate transfer belt 81.

In the foregoing description, there is employed a method of detecting the electric current, but such method is not restrictive and there may also be adopted a method of applying a predetermined current to the secondary transfer roller 40 and detecting the generated voltage.

Also the above-described detection step may be executed in any of the primary transfer positions instead of the secondary transfer position. For example there can be executed a method of applying a predetermined voltage to the primary transfer roller 4 in an image non-forming period and detecting the flowing current. It is naturally possible also to apply a predetermined current to the primary transfer roller 4 and to detect the generated voltage. At such detection, the primary transfer roller 4 is maintained in contact with the intermediate transfer belt 81 while the opposed photosensitive drum is also in contact with the intermediate transfer belt 81.

Also it is more preferable, in case of an abrupt decrease of the resistance of the intermediate transfer belt 81 (for example if the detected current or voltage is significantly distant in the undesirable direction from the threshold value), to control grinding ability of the ability of the abrasive roller by the CPU so as to reduce the time period of the detection mode. Such control can be achieved, for example, by varying the pressure between the abrasive roller and the backup brush, the peripheral speed of the abrasive roller or the rotating direction of the abrasive roller.

Also in the present embodiment, the surface of the intermediate transfer belt 81 is ground as explained in the foregoing to reduce the contact area between the photosensitive drums 1*a*–1*d* and the intermediate transfer belt 81 thereby preventing the transfer of the releasing oil to the photosensitive drums 1*a*–1*d* after all, but the prevention of transfer of the releasing oil can also be attained by grinding the surface of the photosensitive drums. However, in the image forming apparatus of the present invention or the conventional apparatus shown in FIG. 7, such roughing of the surface of the photosensitive drums has not been possible since the electrostatic latent image is formed by uniformly polishing the entire surface of the photosensitive drums 1*a*–1*d* for uniform charging in the thrust direction and exposing such charge surface to laser beams, and there has to be considered the influence of scattering on the light from the laser or LED.

In the following there will be explained the two-side image forming process (two-side mode).

In the present embodiment, the recording material of a basic weight of 105 g/m$^2$ or less is handled as plain paper and, in the image forming apparatus shown in FIG. 1, can be fed from the cassette 60 and subjected to automatic two-side image formation. When the user selects "automatic two-side" on the operation unit the recording material subjected to the image formation on the front surface is fixed by a fixing device (paired rollers) 11 of which surface is coated with the releasing oil, then conveyed through a surface reversing path 61 and once stored in a cassette 62 for two-side image formation. Then the original placed on the original glass plate is changed to an image to be formed on the back surface of the recording material, and the image forming start button is depressed again, whereby the image formation on the back surface of the recording material is started. The image forming apparatus is equipped with a manual feed tray 65, and, in case of feeding from such tray, the user depressed a "two-side" button on the operating display unit whereby there are assumed the image forming conditions similar to those in the two-side copying mode.

In case of automatic two-side image formation, the image formation on the front surface of the recording material is completed, and the recording material is once stored in the two-side image forming cassette 62, and then, the original is changed to an image for back surface of the recording material, and the image formation is executed on the back surface of the recording material by the actuation of the image forming start button.

The present embodiment is featured by a fact that the surface of the intermediate transfer belt 81 is ground thereafter. In the present embodiment, the abrasive means 20 is formed in the shape of roller, and a backup brush 28 for assisting the grinding operation is provided at the back side opposed to the abrasive roller 20 across the intermediate transfer belt 81. The abrasive roller 20 and the backup brush 28 can be brought into contact with the intermediate transfer belt 81 at the substantially same time.

The abrasive roller 20 is brought into contact with the surface of the intermediate transfer belt 81 at a predetermined timing to grind the surface of the intermediate transfer belt 81, thereby forming irregularities on the belt surface though the releasing oil is deposited on the belt surface. The surface irregularities on the intermediate transfer belt 81 and the abraded powder sticking on the belt surface function as spacers (oil transfer preventing layer) between the intermediate transfer belt 81 and the photosensitive drums 1 (1*a*–1*d*) and between the intermediate transfer belt 81 and the recording material conveying belt 8, whereby there is reduced the contact areas between the intermediate transfer belt and the photosensitive drum and between the intermediate transfer belt and the recording material conveying belt when they are mutually close or in mutual contact, and the oil transfer to the photosensitive drums 1 can be eventually reduced or prevented.

Also even if the releasing oil is once deposited on the intermediate transfer belt or the recording material conveying belt, such oil is scraped off and removed by the recording material in the subsequent image formation on the front surface (first surface). For example, in case of two-side image formation on 50 recording materials in succession, the amount of oil deposited on the surface of the intermediate transfer belt and on the surface of the recording material conveying belt gradually increases at the image formations on the back (second) surface, but the oil amount gradually decreases by executing image formation of one-side only (first surface only), so that the oil transfer onto the photosensitive drums does not occur. Consequently the level of roughing of the surface of the intermediate transfer belt is affected by the number of continuous image formations on the second surface of the recording materials.

Figure 2:
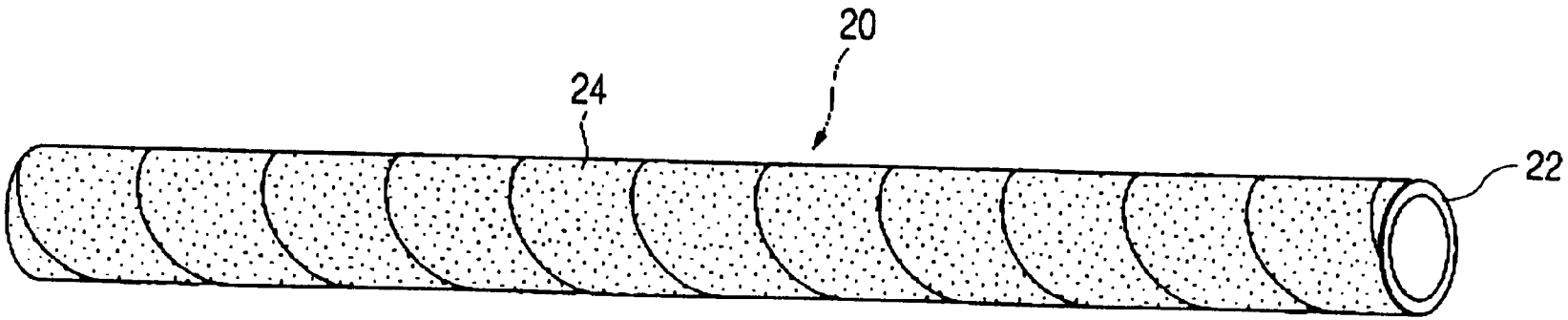
FIG. 2 is a perspective view showing an abrasive roller for an intermediate transfer belt employed in the image forming apparatus shown in FIG. 1.

In consideration of the foregoing, the present embodiment employed an intermediate transfer belt 81 composed of polycarbonate resin (PC) and an abrasive roller 20 composed, as shown in FIG. 2, of an aluminum core 22 on which spirally wound was a sheet 24 with dispersed abrasive grains of #600 (Imperial Lapping Film #600 manufactured by 3M Company) as abrasive. In this manner there can be prevented the peeling of the sheet with dispersed abrasive grains from the core metal. The other materials can be used for the intermediate transfer belt and the abrasive member.

The size of the abrasive grains is preferably in a range of #200 to #1000 in consideration of the grinding ability, and #400 to #800 in consideration of the durability of the belt.

The amount of the releasing oil remaining per unit area on the surface of the recording material after the image formation on the front surface of the recording material is represented by M(d) (mg/cm$^2$), wherein d is the toner bearing amount (mg/cm$^2$) per unit area on the recording material bearing the toner image thereon.

Figure 3:
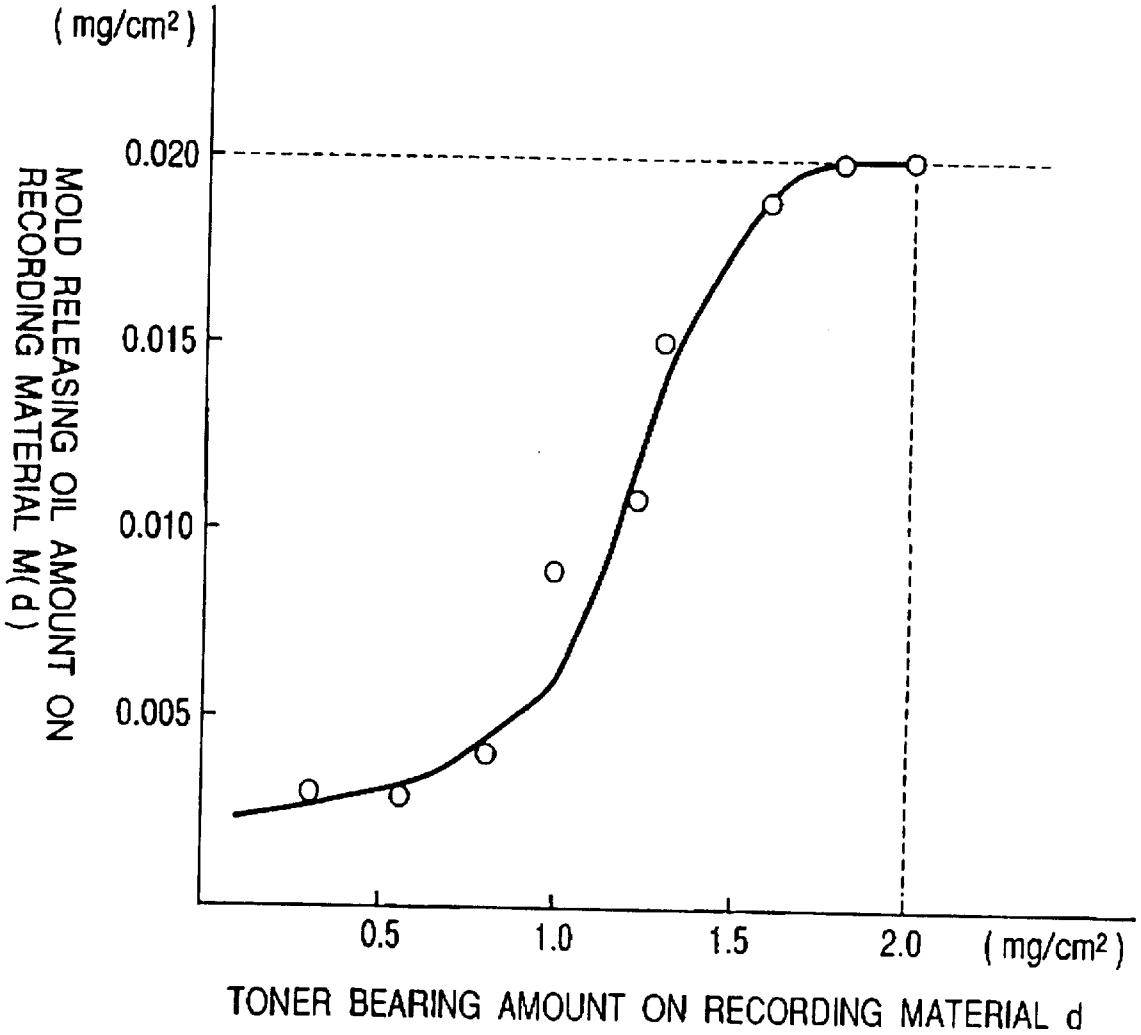
FIG. 3 is a chart showing a relationship between a toner amount per unit area borne on a surface of the recording material and a releasing oil amount per unit area residual thereon.

As shown n FIG. 3, the releasing oil amount M remaining on the surface of the recording material depends on the toner bearing amount d on the recording material. This is because, if the toner bearing amount is large on the recording material (20 mg/cm$^2$ at maximum in the present example), the releasing oil which should penetrate into the interior of the recording material after the fixation of the toner image and should not remain on the surface of the recording material is intercepted by the thick fused toner layer, thereby remaining on the surface of the recording material.

Figure 4:
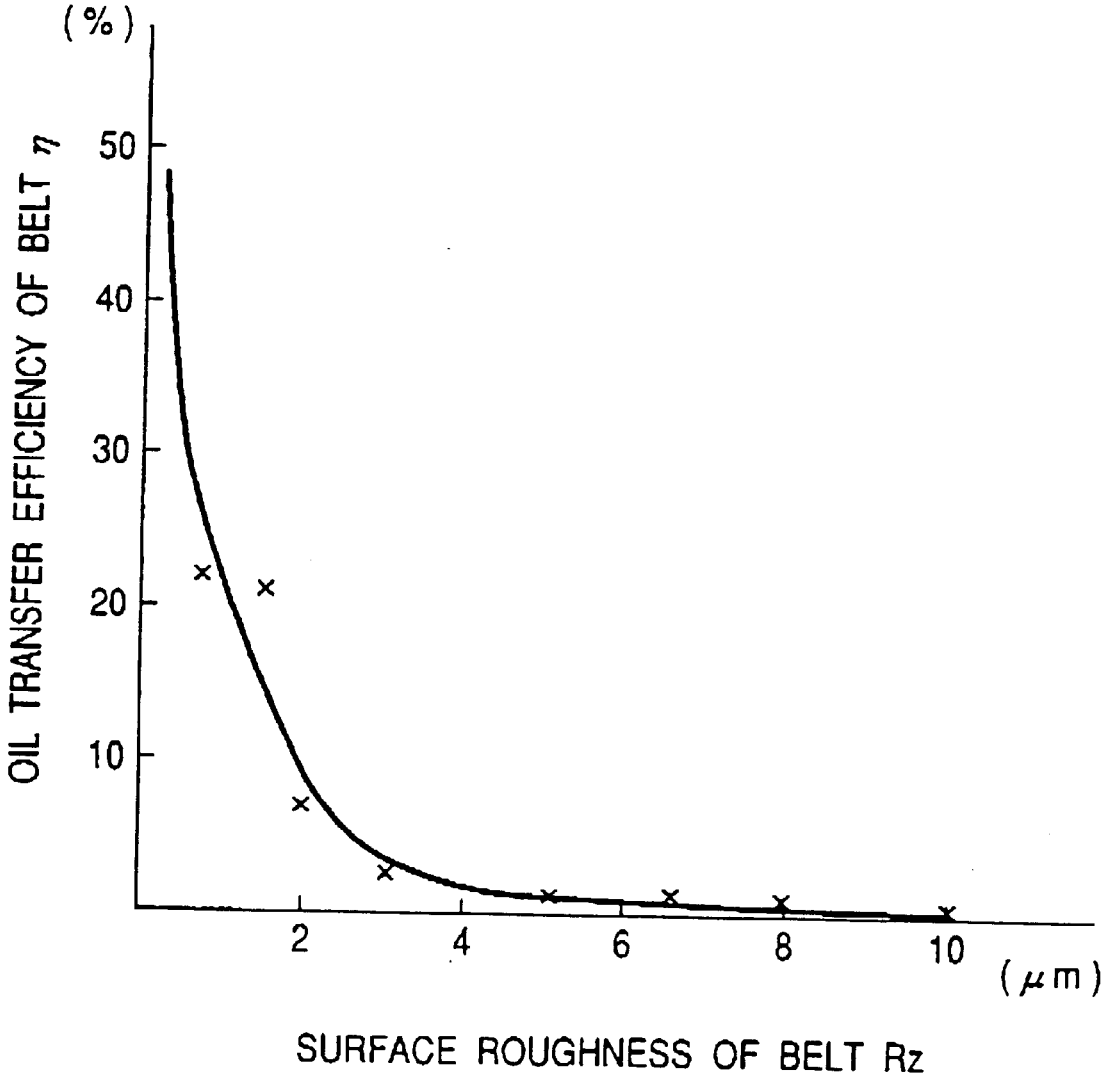
FIG. 4 is a chart showing a relationship between a surface roughness of the belt and a oil transfer efficiency thereof.

Then, the transfer efficiency $\eta$ of the releasing oil to the intermediate transfer belt at the image formation on the back surface of the recording material is represented by $\eta=\eta(r)$, wherein r is the ten-point-average roughness Rz (defined in JIS B0601) of the surface of the intermediate transfer belt. The oil transfer efficiency $\eta$ of the intermediate transfer belt is inversely proportional, as shown in FIG. 4, to the roughness Rz of the surface of the intermediate transfer belt.

Based on these parameters the amount Mt (mg/cm$^2$) of the releasing oil per unit area on the recording material conveying belt 8 after x sheets of two-side image formations is represented, with the transfer efficiency $\eta\mathbf{1}$ of the releasing oil from the recording material to the recording material conveying belt 8, by:

$$Mt=x\cdot\eta\mathbf{1}\cdot M(d).$$

The oil transfer to the intermediate transfer belt 81 occurs when the value Mt exceeds a certain threshold value Mc1. However M(d) and $\eta\mathbf{1}(r)$ vary according to the kind of the recording material, and Mc1 is also dependent on the surface roughness of the intermediate transfer belt.

Then the transfer efficiency $\eta\mathbf{2}(r)$ of oil from the recording material conveying belt to the intermediate transfer belt depends on the surface roughness of the intermediate transfer belt, and the oil amount Mt1 transferred onto the intermediate transfer belt is represented by:

$$Mt\mathbf{1}=x\cdot\eta\mathbf{1}\cdot\eta\mathbf{2}(r)\cdot M(d).$$

Figure 5:
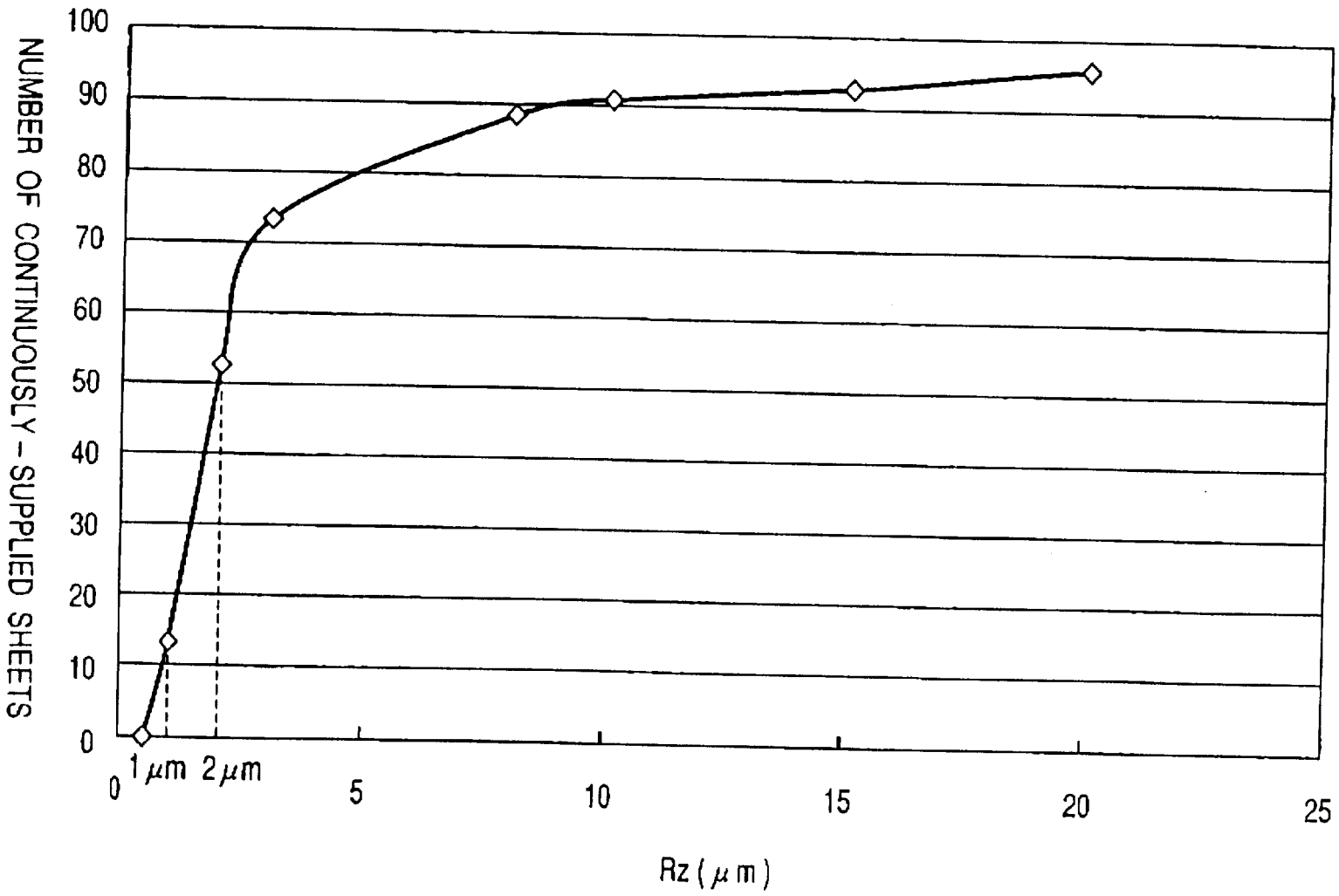
FIG. 5 is a chart showing a relationship between a surface roughness Rz of the intermediate transfer belt and a number of continuous back surface image formations (number of images with oil transfer)

The oil amount transferred onto the photosensitive drum has to satisfy the following formula:

$$Mc\mathbf{1}>Mt\mathbf{1}\cdot\eta\mathbf{3}(r)=x\cdot\eta\mathbf{1}\cdot\eta\mathbf{2}(r)\cdot\eta\mathbf{3}(r)\cdot M(d)$$

wherein $\eta\mathbf{3}(r)$ is the transfer efficiency and Mc is the transferred oil amount required for generating the image with transferred oil. The parameters $\eta\mathbf{2}(r)$ and $\eta\mathbf{3}(r)$ substantially depend on the surface roughness Rz of the intermediate transfer belt, as shown in FIG. 4. As will be apparent from the foregoing formula, given that a kind of the recording material and a maximum toner bearing amount are fixed, the oil transfer condition depends on a number of continuous back-surface image formations and the surface roughness Rz of the intermediate transfer belt. FIG. 5 shows the number of sheets before the generation of oil-transferred image (in continuous back-surface image formations) as a function of Rz of the intermediate transfer belt, in case paper CLC80 g of a basic weight of 80 g/m$^2$ (manufactured by Nippon Paper. Industries Co., Ltd.), recommended for the color copying apparatus of Canon Inc., is selected as the recording material and the maximum toner bearing amount per unit area was selected as 2.0 mg/cm$^2$. In comparison with the conventional image forming apparatus for multi transfer of the toner images directly on the recording material, the amount of the releasing oil deposited on the belt member coming into direct contact with the photosensitive drum is lower (because the oil present on the lower roller of the fixing device is deposited on the back surface of the recording material in the image formation on the back surface and is then transferred onto the intermediate transfer belt). Also the releasing oil on the image is once transferred to the recording material conveying belt and is then transferred onto the intermediate transfer belt, so that the amount of oil transferred from the surface image to the intermediate transfer belt is less than that in the image forming apparatus executing multi transfer of the toner images directly onto the recording material. Also, in comparison with the conventional image forming apparatus utilizing multi transfer of the toner images directly onto the recording material and achieving image formation by toner image transfer by way of paper, the direct toner image transfer onto the intermediate transfer belt as in the present embodiment involves danger that the surface texture of the belt appears on the formed image. For this reason, certain surface roughing is necessary but excessive roughness is not acceptable. Stated differently the surface roughing has to be made uniformly to a certain level. Therefore, not only Rz but also the upper limit of the maximum height of irregularities Rmax (as defined in the JIS B0601) are very important.

In case the surface roughness is small, the transfer efficiency $\eta$ becomes larger (FIG. 4), so that the number x of sheets of continuous two-side image formations has to be made smaller (a number of sheets of image formations between the grinding operations has to be made smaller), whereby the productivity of two-side image formations is significantly deteriorated. In the present embodiment, the oil transfer to the photosensitive drum can be prevented with the surface roughness Rz of the intermediate transfer belt 81 of 1 μm or larger, but the number of sheets of continuous two-side image formations has to be selected as 10 or less (cf. FIG. 5). For this reason the surface roughness is more preferably selected as 2 μm or larger (the cassette 62 for two-side image formation of the present embodiment has a capacity of 50 sheets).

Also in the present embodiment, Rz of the intermediate transfer belt 81 is selected at about 10 μm at maximum, but the defective image resulting from abnormal transfer (including primary and secondary transfers) was very slight at such surface roughness Rz and was not observed at all with Rz of 8 μm or less. On the other hand, the abnormal discharge in the image transfer became conspicuous in the resulting image with a forcedly prepared surface roughness Rz up to about 15 μm. Consequently the surface roughness Rz of the intermediate transfer belt 81 is preferably less than 15 μm and more preferably does not exceed 8 μm.

Also a local surface roughness of the intermediate transfer belt 81 may be visible on the image. The abnormal transfer was not observed at all on the image with Rmax not exceeding 10 μm, but was slightly observed with Rmax not exceeding 15 μm and the abnormal discharge images became conspicuous at 20 μm. Consequently Rmax is preferably less than 20 μm and more preferably does not exceed 10 μm.

As will be apparent from the foregoing formula, the releasing oil transfer onto the photosensitive drum depends on the number of sheets of two-side image formations, the toner bearing amount on the recording material and the surface roughness of the intermediate transfer belt. In the present embodiment, therefore, the grinding time of the intermediate transfer belt 81 is varied according to the number of sheets of two-side image formations (number of copies) and the toner bearing amount on the recording material.

The number of sheets of two-side image formations (number of two-side copies) can be recognized from the data entered in advance by the user on the operation unit, and the toner bearing amount per unit area on the recording material can be detected by a video counter at the latent image formation, by means for detecting the density on the photosensitive drum or by means for detecting the toner density on the recording material. Thus the grinding time can be made minimum by setting the time in advance corresponding to the number of copies or the toner bearing amount.

The grinding operation with the abrasive roller may also be executed prior to the start of the image forming operation for every formation of the two-side images on a predetermined number of recording materials. In the present embodiment, the grinding operation is executed prior to the start of the image forming operation, so that there can be prevented the image defect or the color registration error, resulting from an additional load applied by the abrasive roller onto the intermediate transfer belt 81.

Such grinding time maintained at the minimum level not only improves the productivity of the two-side copy but also prolongs the service life of the intermediate transfer belt, since excessive abrasion of the intermediate transfer belt tends to induce cracking in the intermediate transfer belt.

Also in the present embodiment, even if the image defect such as toner fogging is slightly induced by the oil transferred from the intermediate transfer belt to the photosensitive drum, the toner image formed at first is prepared with yellow toner which has the lowest visibility, so that the image defect becomes less conspicuous.

Also in the present embodiment, the abrasive roller is positioned at the downstream side of the cleaner 16, in order that the abraded powder formed by the abrasive roller can satisfactory function as the spacer for preventing oil transfer between the intermediate transfer belt and the recording material conveying belt.

[Embodiment 2]

In this embodiment, the intermediate transfer belt 81 is ground immediately after the image formation on the front surface of the recording material. For example, in case the user instructs image formation on both sides of the recording material to the image forming apparatus, after the image formation on the front surface of the recording material is completed, the abrasive roller 20 is brought into contact with the intermediate transfer belt 81 and the grinding operation for the intermediate transfer belt 81 is started by the rotation of the intermediate transfer belt 81 itself. After the intermediate transfer belt 81 is ground for a predetermined time, there is initiated the image formation on the back surface of the recording material.

As explained in the foregoing, the intermediate transfer belt 81 is ground to form minute irregularities on the surface thereof and to cause the abraded powder to function as the spacer between the intermediate transfer belt and the recording material, thereby preventing deposition of the releasing oil, impregnated on the surface of the recording material at the fixing operation, onto the surface of the intermediate transfer belt at the secondary transfer in the image formation on the back surface of the recording material, and eventually reducing or preventing the transfer of the releasing oil onto the photosensitive drum 1.

In the present embodiment, the timing of grinding operation of the intermediate transfer belt is different from that in the embodiment 1, but similarly there is prevented the transfer of the releasing oil from the recording material to the intermediate transfer belt, thereby preventing the oil transfer to the photosensitive drum at the more upstream side.

[Embodiment 3]

This embodiment is applied to an image forming apparatus in which the toner image is fixed by heat and pressure simultaneous with the secondary transfer from the intermediate transfer belt onto the recording material. The basic configuration of the image forming apparatus of the present embodiment is basically same as that of the embodiment 1, shown in FIG. 1, except for an additional function of executing fixation simultaneous with the secondary transfer of the toner image from the intermediate transfer belt. In the following description, FIG. 1 is referred to whenever is necessary.

In case of executing fixation simultaneously with the secondary transfer, the releasing oil is deposited directly on the intermediate transfer belt 81 regardless whether the image formations are executed on two sides of the recording material. Therefore, in order to avoid the oil transfer onto the photosensitive drum 1 (1*a*–1*d*), it is necessary to rough the surface of the intermediate transfer belt 81 with the abrasive roller 20 as in the foregoing embodiments.

In addition to the prevention of deposition of the releasing oil onto the intermediate transfer belt 81 and eventually onto the photosensitive drum 1 (1*a*–1*d*) as in the embodiment 1, the present embodiment provides an effect of scraping off the fixing offset toner deposited on the intermediate transfer belt.

Thus the roughing of the surface of the intermediate transfer belt with the abrasive means is effective also in the image forming apparatus utilizing secondary transfer simultaneous with fixation as in the present embodiment.

[Embodiment 4]

This embodiment is featured by a fact that the pressure of the abrasive roller 20 against the intermediate transfer belt 81, namely the grinding ability, is made variable according to the number of sheets of two-side copies or the toner bearing amount on the recording material.

The means for varying the above-mentioned pressure may achieve such pressure variation by varying the penetration amount of the abrasive roller 20 into the intermediate transfer belt 81 or by varying the penetration amount of the backup brush 28, positioned at the back side of the intermediate transfer belt and opposed to the abrasive roller 20, into the intermediate transfer belt.

[Embodiment 5]

Figure 6:
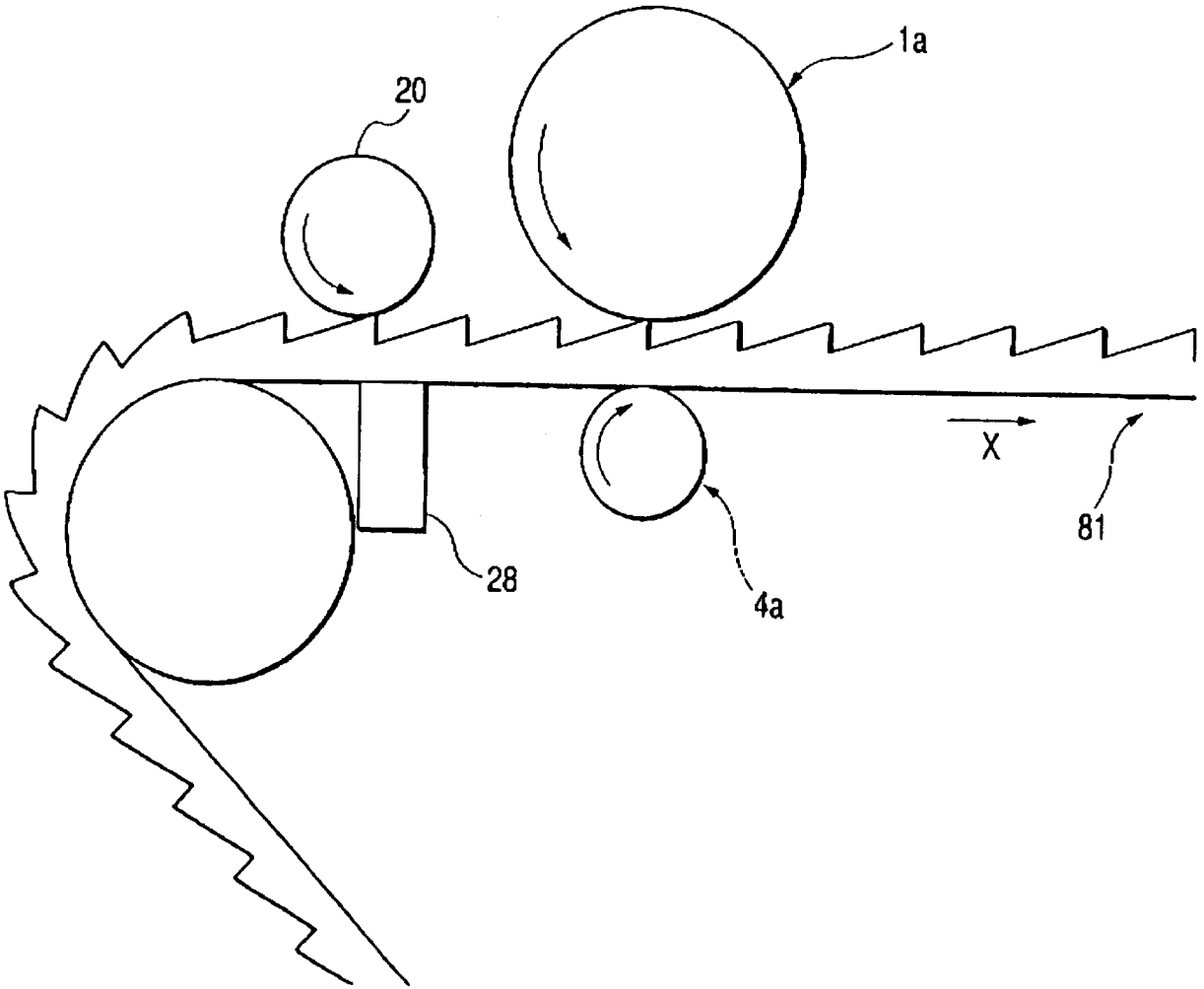
FIG. 6 is a schematic view of an embodiment 5.

Abrasion of the intermediate transfer belt in such a manner that the abraded texture (abraded grain) after the grinding operation is not interlocking with or is in line with the proceeding direction of the belt is effective for preventing the smeared image, preventing the transfer of the releasing oil onto the photosensitive drum and extending the service life of the photosensitive drum (by preventing scar formation thereon) (cf. FIG. 6). In this embodiment, such grinding operation is attained by rotating the abrasive roller in the forward direction with respect to the rotating direction of the intermediate transfer belt, at a peripheral speed higher than that of the intermediate transfer belt.

[Embodiment 6]

In this embodiment, the grinding time is shortened by rotating the intermediate transfer belt in the grinding operation at a speed higher than that in the normal image forming operation. This embodiment is particularly effective in order to reduce the waiting time, in case plural revolutions of the belt are required for grinding operation.

In the foregoing embodiments, an abrasive roller is employed as the abrasive means for the intermediate transfer belt, but the present invention is not restricted by such roller and may employ any means capable of grinding the surface of the intermediate transfer belt, for example an abrasive brush or an abrasive blade.

The foregoing embodiments have been explained by an image forming apparatus in which the toner images of respective colors are transferred from four image forming units Pa–Pd in succession and in superposition onto the intermediate transfer belt 81 and then collectively transferred from the intermediate transfer belt onto the recording material, but the present invention is not limited to such image forming apparatus. For example the present invention is also applicable to an image forming apparatus in which the toner images of respective colors formed on a single photosensitive drum are transferred in succession and in superposition onto the intermediate transfer belt and then collectively transferred from the intermediate transfer belt onto the recording material. In such case, the abrasive roller is preferably separated from the intermediate transfer belt at least while the abrasive roller is opposed to a toner image borne on the intermediate transfer belt.

The present invention is furthermore applicable to a monochromatic image forming apparatus utilizing an intermediate transfer member.

Also in the foregoing embodiments, the means for conveying the recording material in the secondary transfer position is formed in the shape of a belt, but such configuration is not restrictive and there may be adopted a roller-shaped means for conveying the recording material.

What is claimed is:

1. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means;

a contact member in contact with said intermediate transfer member and receiving a predetermined voltage; and an opposed member provided so as to oppose said contact member through said intermediate transfer member and to be in contact with said intermediate transfer member, wherein said control means controls a timing for grinding said intermediate transfer member by said abrasive means, based on a value of an electric current flowing between said contact member and said opposed member when the predetermined voltage is applied to said contact member.

2. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means;

a contact member in contact with said intermediate transfer member and receiving a predetermined voltage; and an opposed member provided so as to oppose said contact member through said intermediate transfer member and to be in contact with said intermediate transfer member, wherein said control means controls a grinding ability of said abrasive means, based on a value of an electric current flowing between said contact member and said opposed member when the predetermined voltage is applied to said contact member.

3. An apparatus according to claim 1 or 2, wherein said contact member and said opposed member electrostatically transfer the image on said intermediate transfer member to the recording material.

4. An apparatus according to claim 3, wherein the value of the electric current flowing between said contact member and said opposed member is detected when the image is not transferred from said intermediate transfer member to the recording material.

5. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means;

a contact member in contact with said intermediate transfer member and receiving a predetermined voltage; and an opposed member provided so as to oppose said contact member through said intermediate transfer member and to be in contact with said intermediate transfer member, wherein said control means controls a timing for grinding said intermediate transfer member by said abrasive means, based on a value of a voltage generated between said contact member and said opposed member when a predetermined current is applied to said contact member.

6. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means;

a contact member in contact with said intermediate transfer member and receiving a predetermined voltage; and an opposed member provided so as to oppose said contact member through said intermediate transfer member and to be in contact with said intermediate transfer member, wherein said control means controls a grinding ability of said abrasive means, based on a value of a voltage generated between said contact member and said opposed member when a predetermined current is applied to said contact member.

7. An apparatus according to claim 5 or 6, wherein said contact member and said opposed member electrically transfer the image on said intermediate transfer member to the recording material.

8. An apparatus according to claim 7, wherein a value of an electric current flowing between said contact member and said opposed member is detected when the image is not transferred from said intermediate transfer member to the recording material.

9. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means; and a transfer member provided at a side of said intermediate transfer member opposite to a side receiving the transferred image for electrostatically transferring the image on said image bearing member onto said intermediate transfer member, wherein said transfer member is in contact with said intermediate transfer member on transferring the image, wherein said control means controls a timing for grinding said intermediate transfer member by said abrasive means, based on a value of an electric current flowing between said transfer member and said image bearing member when a predetermined voltage is applied to said transfer member.

10. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means; and a transfer member provided at a side of said intermediate transfer member opposite to a side receiving the transferred image for electrostatically transferring the image on said image bearing member onto said intermediate transfer member, wherein said transfer member is in contact with said intermediate transfer member on transferring the image, wherein said control means controls a grinding ability of said abrasive means, based on a value of an electric current flowing between said transfer member and said image bearing member when a predetermined voltage is applied to said transfer member.

11. An apparatus according to claim 9 or 10, wherein the value of the electric current flowing between said transfer member and said image bearing member is detected when the image is not transferred from said image bearing member to said intermediate transfer member.

12. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means; and a transfer member provided at a side of said intermediate transfer member opposite to a side receiving the transferred image for electrostatically transferring the image on said image bearing member onto said intermediate transfer member, wherein said transfer member is in contact with said intermediate transfer member on transferring the image, wherein said control means controls a timing for grinding said intermediate transfer member by said abrasive means, based on a value of a voltage generated between said transfer member and said image bearing member when a predetermined current is applied to said transfer member.

13. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material;

abrasive means for grinding an area of said intermediate transfer member onto which the image is transferred;

control means for controlling a grinding operation of said abrasive means; and a transfer member provided at a side of said intermediate transfer member opposite to a side receiving the transferred image for electrostatically transferring the image on said image bearing member onto said intermediate transfer member, wherein said transfer member is in contact with said intermediate transfer member on transferring the image, wherein said control means controls a grinding ability of said abrasive means, based on a value of a voltage generated between said transfer member and said image bearing member when a predetermined current is applied to said transfer member.

14. An apparatus according to claim 12 or 13, wherein the value of the voltage generated between said transfer member and said image bearing member is detected when the image is not transferred from said image bearing member to said intermediate transfer member.

15. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material; and abrasive means for grinding an area of said intermediate transfer member onto which the image is transferred, wherein an abrasive grain of said intermediate transfer member by said abrasive means is a not-interlocked grain with respect to a rotating direction of said image bearing member.

16. An apparatus according to claim 15, wherein a moving direction of said abrasive means is opposite to that of said intermediate transfer member in a contact position between said abrasive means and said intermediate transfer member.

17. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material; and abrasive means for grinding an area of said intermediate transfer member onto which the image is transferred, wherein a peripheral speed of said intermediate transfer member on grinding said intermediate transfer member by said abrasive means is made higher than a peripheral speed of said intermediate transfer member on forming the image.

18. An image forming apparatus comprising:

an image bearing member for bearing an image thereon;

an intermediate transfer member, wherein the image on said image bearing member is electrostatically transferred onto said intermediate transfer member and the image on said intermediate transfer member is electrostatically transferred onto a recording material; and abrasive means for grinding an area of said intermediate transfer member onto which the image is transferred, wherein said abrasive means includes a first member contacting an image receiving side of said intermediate transfer member, and a second member opposed to said first member through said intermediate transfer member and contacting with said intermediate transfer member, wherein said first member includes a rotary member and a sheet provided on a said rotary member and having abrasive dispersed thereon.

19. An apparatus according to claim 18, wherein said sheet is wound spirally on said rotary member.

20. An apparatus according to any one of claims 1, 2, 5, 6, 9, 10, 12, 13, 15, 17, or 18, wherein images of plural colors are transferred in succession and in superposition from said image bearing member to said intermediate transfer member, and the images of plural colors on said intermediate transfer member are transferred to the recording material.

21. An apparatus according to any one of claims 1, 2, 5, 6, 9, 10, 12, 13, 15, 17, or 18, wherein a plurality of image bearing members are provided in order to respectively bear images of plural colors, the images are electrostatically transferred in succession and in superposition from said respective image bearing members to said intermediate transfer member, and the images of plural colors on said intermediate transfer member are electrostatically transferred to the recording material.

22. An apparatus according to any one of claims 1, 2, 5, 6, 9, 10, 12, 13, 15, 17, or 18, wherein said intermediate transfer member comprises a resinous sheet.

23. An image forming apparatus comprising:

an image bearing member for bearing an image thereon;

an intermediate transfer member to which the image on said image bearing member is transferred;

transfer means for transferring the image on said intermediate transfer member to a recording material, said transfer means including a pressing member for pressing the recording material against said intermediate transfer member on transferring the image; and fixing means for fixing the image, transferred from said intermediate transfer member to the recording material, on said recording material, said fixing means being coated with oil on a surface contacting said recording material;

wherein, after the image is fixed on a first surface of the recording material by said fixing means, an image can be formed on a second surface of the recording material opposite to said first surface, wherein an area of said intermediate transfer member coming into contact with said image bearing member has a rough surface, and wherein a surface roughness Rz of said area of said intermediate transfer member coming into contact with said image bearing member is at least 1 $\mu$m and less than 15 $\mu$m.

24. An apparatus according to claim 23, wherein said area of said intermediate transfer member has a surface roughness Rz within a range from 2 to 8 $\mu$m.

25. An apparatus according to claim 23, wherein said area of said intermediate transfer member has a surface roughness Rmax within a range from 2 to 10 $\mu$m.

26. An apparatus according to any of claims 23, 24 or 25, further comprising abrasive means for grinding said intermediate transfer member.

27. An apparatus according to claim 26, wherein said abrasive means grinds said intermediate transfer member at least over an entire periphery of said intermediate transfer member.

28. An apparatus according to claim 26, wherein said abrasive means is contactable with and separable from said intermediate transfer member and is in contact with said intermediate transfer member on grinding.

29. An apparatus according to claim 28, wherein said abrasive means is separated from said intermediate transfer member when the image is transferred from said image bearing member to said intermediate transfer member.

30. An apparatus according to claim 28, wherein said abrasive means is separated from said intermediate transfer member when the image is transferred from said intermediate transfer member to the recording material.

31. An image forming apparatus comprising:

an image bearing member for bearing an image thereon;

an intermediate transfer member to which the image on said image bearing member is transferred;

transfer means for transferring the image on said intermediate transfer member to a recording material, said transfer means including a pressing member for pressing the recording material against said intermediate transfer member on transferring the image;

fixing means for fixing the image, transferred from said intermediate transfer member to the recording material, on said recording material, said fixing means being coated with oil on a surface contacting said recording material, wherein, after the image is fixed on a first surface of the recording material by said fixing means, an image can be formed on a second surface of the recording material opposite to said first surface, and wherein an area of said intermediate transfer member coming into contact with said image bearing member has a rough surface;

abrasive means for grinding said intermediate transfer member, wherein said abrasive means grinds said intermediate transfer member at least over an entire periphery of said intermediate transfer member; and counter means for counting a number of image formations on said second surface of the recording material.

32. An apparatus according to claim 31, wherein said abrasive means grinds said intermediate transfer member every time a number counted by said counter means reaches a predetermined value.

33. An image forming apparatus comprising:

an image bearing member for bearing an image thereon;

an intermediate transfer member to which the image on said image bearing member is transferred;

transfer means for transferring the image on said intermediate transfer member to a recording material, said transfer means including a pressing member for pressing the recording material against said intermediate transfer member on transferring the image;

fixing means for fixing the image, transferred from said intermediate transfer member to the recording material, on said recording material, said fixing means being coated with oil on a surface contacting said recording material, wherein, after the image is fixed on a first surface of the recording material by said fixing means, an image can be formed on a second surface of the recording material opposite to said first surface, and wherein an area of said intermediate transfer member coming into contact with said image bearing member has a rough surface; and abrasive means for grinding said intermediate transfer member, wherein an abrasive grain of said intermediate transfer member by said abrasive means is a not-interlocked grain with respect to a rotating direction of said image bearing member.

34. An apparatus according to claim 33, wherein a moving direction of said abrasive means is opposite to that of said intermediate transfer member in a contact position between said abrasive means and said intermediate transfer member.

35. An image forming apparatus comprising:

an image bearing member for bearing an image thereon;

an intermediate transfer member to which the image on said image bearing member is transferred;

transfer means for transferring the image on said intermediate transfer member to a recording material, said transfer means including a pressing member for pressing the recording material against said intermediate transfer member on transferring the image;

fixing means for fixing the image, transferred from said intermediate transfer member to the recording material, on said recording material, said fixing means being coated with oil on a surface contacting said recording material, wherein, after the image is fixed on a first surface of the recording material by said fixing means, an image can be formed on a second surface of the recording material opposite to said first surface, and wherein an area of said intermediate transfer member coming into contact with said image bearing member has a rough surface; and abrasive means for grinding said intermediate transfer member, wherein a peripheral speed of said intermediate transfer member on grinding said intermediate transfer member by said abrasive means is made higher than a peripheral speed of said intermediate transfer member on forming the image.

36. An image forming apparatus comprising:

an image bearing member for bearing an image thereon;

an intermediate transfer member to which the image on said image bearing member is transferred;

transfer means for transferring the image on said intermediate transfer member to a recording material, said transfer means including a pressing member for pressing the recording material against said intermediate transfer member on transferring the image;

fixing means for fixing the image, transferred from said intermediate transfer member to the recording material, on said recording material, said fixing means being coated with oil on a surface contacting said recording material, wherein, after the image is fixed on a first surface of the recording material by said fixing means, an image can be formed on a second surface of the recording material opposite to said first surface, and wherein an area of said intermediate transfer member coming into contact with said image bearing member has a rough surface; and abrasive means for grinding said intermediate transfer member, wherein said abrasive means includes a first member contacting an image receiving side of said intermediate transfer member, and a second member opposed to said first member through said intermediate transfer member and contacting with said intermediate transfer member, wherein said first member includes a rotary member and a sheet provided on said rotary member and having abrasive dispersed thereon.

37. An apparatus according to claim 36, wherein said sheet is wound spirally on said rotary member.

38. An apparatus according to any one of claims 25, 31, 33, 35, or 36, wherein images of plural colors are transferred in succession and in superposition from said image bearing member to said intermediate transfer member, and the images of plural colors on said intermediate transfer member are transferred to the recording material.

39. An apparatus according to any one of claims 23, 31, 33, 35, or 36, wherein a plurality of image bearing members are provided in order to respectively bear images of plural colors, the images are electrostatically transferred in succession and in superposition from said respective image bearing members to said intermediate transfer member, and the images of plural colors on said intermediate transfer member are electrostatically transferred to the recording material.

40. An apparatus according to any one of claims 23, 31, 33, 35, or 36, wherein said pressing member is movable between a first position for pressing the recording material against said intermediate transfer member and a second position separated from said intermediate transfer member.

41. An apparatus according to claim 40, wherein said pressing member is maintained in said first position while the images are transferred from said intermediate transfer member in succession to a first recording material and a second recording material, and said pressing member is moved to said second position after the image is transferred to said second recording material.

42. An apparatus according to any one of claims 23, 31, 33, 35, or 36, wherein said intermediate transfer member comprises a resinous sheet.

* * * * *

UNITED STATES PATENT AND TRADEMARK OFFICE

CERTIFICATE OF CORRECTION

PATENT NO. : 6,360,071 B1
DATED : March 19, 2002
INVENTOR(S) : Takeshi Tomizawa

It is certified that error appears in the above-identified patent and that said Letters Patent is hereby corrected as shown below:

Column 5,
Line 26, "stats" should read -- status --.

Column 6,
Line 55, "roller," should read -- a roller, --.

Column 18,
Line 65, "claims 25," should read -- claims 23, --.

Signed and Sealed this

Twenty-eighth Day of May, 2002

*Attest:*

*Attesting Officer*

JAMES E. ROGAN
*Director of the United States Patent and Trademark Office*